US005436453A

United States Patent [19]

Chang et al.

[11] Patent Number: 5,436,453

[45] Date of Patent: Jul. 25, 1995

[54] DUAL MODE ENERGY DETECTOR HAVING MONOLITHIC INTEGRATED CIRCUIT CONSTRUCTION

[75] Inventors: Peter L. D. Chang, Nashua; William R. Hood, Amherst, both of N.H.

[73] Assignee: Lockheed Sanders, Inc., Nashua, N.H.

[21] Appl. No.: 137,524

[22] Filed: Oct. 15, 1993

[51] Int. Cl.[6] ..... H01Q 21/280

[52] U.S. Cl. ..... 250/338.1; 343/725

[58] Field of Search ..... 250/338.1; 343/725, 343/720, 909

[56] References Cited

U.S. PATENT DOCUMENTS

| | | | |
|---|---|---|---|
| 3,746,454 | 7/1973 | Pace et al. | 250/332 |
| 4,477,814 | 10/1984 | Brumbaugh et al. . | |
| 4,636,797 | 1/1987 | Saffold et al. . | |
| 4,652,885 | 3/1987 | Saffold et al. . | |
| 4,698,638 | 10/1987 | Branigan et al. . | |
| 4,791,427 | 12/1988 | Raber et al. . | |
| 4,866,454 | 9/1989 | Droessler et al. . | |
| 5,182,564 | 1/1993 | Burkett et al. . | |
| 5,185,613 | 2/1993 | Whatmore et al. | 343/909 |
| 5,214,438 | 5/1993 | Brusgard et al. | 343/725 |
| 5,327,149 | 7/1994 | Kuffer | 343/720 |

*Primary Examiner*—Paul M. Dzierzynski
*Assistant Examiner*—Richard Hanig
*Attorney, Agent, or Firm*—David W. Gomes

[57] ABSTRACT

The present invention provides a monolithic integrated detector array for detecting both infrared, IR, and millimeter wave, MMW, energy. Elements include an integrated circuit substrate having both IR sensing elements and MMW antenna elements formed within a predetermined area thereon, said IR sensing elements including a first multiplicity of IR sensing elements substantially evenly distributed across the predetermined area of the substrate, said MMW antenna elements including a second multiplicity of antenna elements distributed over the predetermined area with individual antenna elements being located between individual IR sensing elements; and lens means substantially covering the predetermined area for collecting substantially all of the IR energy incident thereon and for distributing collected IR energy to the multiplicity of IR sensing elements, said lens means being adapted to be substantially transparent to MMW energy incident upon the predetermined area.

8 Claims, 1 Drawing Sheet

DUAL MODE ENERGY DETECTOR HAVING MONOLITHIC INTEGRATED CIRCUIT CONSTRUCTION

BACKGROUND OF THE INVENTION

1. Field of the Invention

The present invention generally relates to solid state energy detectors and, in particular, to such detectors which combine the detection of more than one energy mode.

2. Statement of the Prior Art

For some time there has been an interest in having an imaging apparatus which is capable of simultaneously or alternatively acquiring images using both millimeter wave and infrared energy. While millimeter wave, MMW, energy, as found in radar systems, is more effective than infrared IR, over long distance and in adverse weather conditions, IR energy provides greater resolution. Thus, the hope of combining these techniques into a single device is to achieve the advantages of both techniques. Numerous devices have been developed which attempt to integrate both MMW and IR sensors into the same device. Such devices usually use the same energy collection portal and then direct the different types of energy to separate and different sensing devices using complex optical arrangements. Disadvantageously, this approach cannot be used for manufacturing high density arrays and suffers from difficult problems in combining the data from the separate sensors, a process known as data fusion.

Although integrated circuit construction techniques have been used for some time to produce MMW antennas as integrated circuit conductors on semiconductor substrates, it has only been recently that IR sensors have been constructed using semiconductors and integrated circuit construction techniques. Nonetheless, the development of semiconductor IR sensors has progressed in such forms as HgCdTe detectors, quantum well infrared photodetectors (QWIPs) and infrared hot-electron transistors (IHETs).

A related development has been the combination of such semiconductor IR sensors with the advanced optical techniques of microlenses. Each IR pixel element in an array is associated with its own microlens which allows the size of the pixel element to be reduced while maintaining the area of incident IR energy via the microlens. The microlens concentrates the incident photons to a smaller area thus reducing the required detector area and volume.

SUMMARY OF THE INVENTION

Accordingly, in its broadest form, the present invention provides a monolithic integrated circuit detector array having elements for detecting incident energy having respectively longer and shorter wavelengths, comprising: an integrated circuit substrate having different sensing elements for detecting energy having longer and shorter wavelengths, said sensing elements being distributed over a predetermined area of the substrate; said sensing elements including a first multiplicity of sensing elements substantially evenly distributed across the predetermined area for detecting energy having the shorter wavelength and a second multiplicity of sensing elements distributed over the predetermined area for detecting energy having the longer wavelength, with individual elements of the second multiplicity of elements being located between individual elements of the first multiplicity of sensing elements; and lens means substantially covering the predetermined area for collecting substantially all of the shorter wavelength energy incident thereon and for distributing collected energy to the first multiplicity of sensing elements, said lens means being adapted to be substantially transparent to longer wavelength energy incident upon the predetermined area.

In another form, the present invention provides a monolithic integrated detector array for detecting both infrared, IR, and millimeter wave, MMW, energy, comprising: an integrated circuit substrate having both IR sensing elements and MMW antenna elements formed within a predetermined area thereon; said IR sensing elements including a first multiplicity of IR sensing elements substantially evenly distributed across the predetermined area of the substrate; said MMW antenna elements including a second multiplicity of antenna elements distributed over the predetermined area with individual antenna elements being located between individual IR sensing elements; and lens means substantially covering the predetermined area for collecting substantially all of the IR energy incident thereon and for distributing collected IR energy to the multiplicity of IR sensing elements, said lens means being adapted to be substantially transparent to MMW energy incident upon the predetermined area.

BRIEF DESCRIPTION OF THE DRAWINGS

The present invention is illustratively described and shown in reference to the appended drawings in which.

DETAILED DESCRIPTION OF THE DRAWINGS

Figure 1:
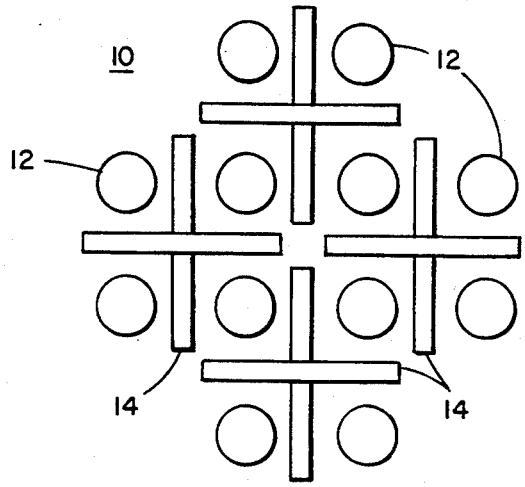
FIG. 1 is a plan view of an arrangement of sensing elements constructed in accordance with one embodiment of the present invention.

FIG. 1 is a plan view of a portion of the surface of a monolithic semiconductor substrate 10 which includes a multiplicity of IR detector elements 12 and a multiplicity of MMW detector elements 14. The portion of the substrate 10 which is shown is intended to be part of and to represent a larger image sensing focal plane array. The entire array would cover a predetermined image sensing area, also represented by the area shown.

IR elements 12 are intended to be uniformly distributed over the surface 16 of the substrate 10 for the entire imaging area. The distribution pattern shown is orthogonal, however, different patterns such as polar or diamond may also be used. Different patterns will necessitate different forms of data processing for the construction of images from the element output signals.

As shown in FIG. 1, the IR sensing elements 12 have a uniform distribution over the image sensing area. The MMW antenna elements 14 are also distributed over the area of the substrate. They are formed, in the embodiment shown, as crossed dipoles, however, different configurations may be used depending upon the application. Individual antenna elements 14 are located between individual IR sensors 12 and thus, their configuration may vary with or depend upon the distribution of IR sensor elements 12.

Figure 2:
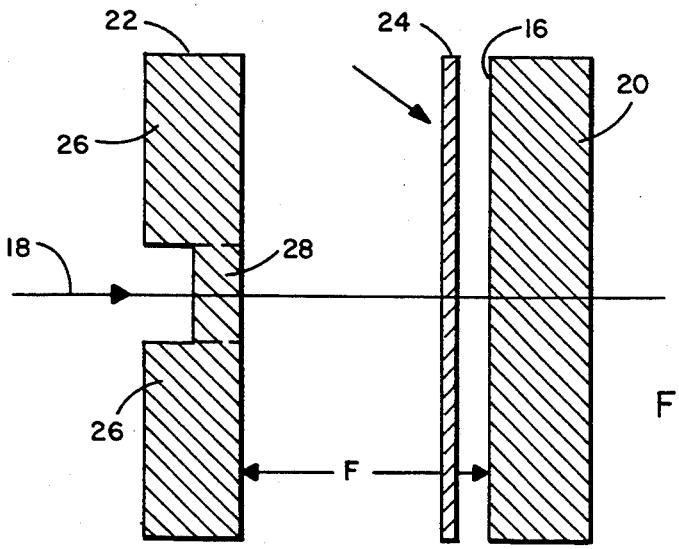
FIG. 2 is a representational side view of one embodiment constructed in accordance with the present invention including the sensing elements of FIG. 1.

As mentioned, substrate 10 is part of a focal plane array used for sensing images in conjunction with imaging optics. An example of such an arrangement is representationally shown in FIG. 2 as a side view. A focal plane array 20 is located along an optical axis 18 with a fresnel lens 22 and a microlens 24.

Fresnel lens 22 functions as the object lens for the array 20 and includes a MMW focusing portion 26 and a centrally located IR focusing portion 28. Lens 22 is constructed with a circular energy incident area where the lens portions 26,28 are concentric. A difference in thickness is shown between the portions 26 and 28 which is due to the difference in wavelengths between MMW and IR energy, respectively. The construction of such lenses is known in the art. Optionally, the MMW portion 26 may be coated with IR reflective material to prevent unfocused IR enrgy from reaching the array 20 and the separate portions 26,28 may be constructed using different materials. The relative size or area of the lens portions 26,28 will depend upon the relative signal sensitivity desired for the different energy modes. In one form, the MMW portion 26 would be used at long range requiring high signal sensitivity and the IR portion 28 would be used at close range using low signal sensitivity. For this application, the size of IR portion 28 could be minimized with respect to the size of MMW portion 26.

The IR imaging portion 28 focuses IR energy over the imaging area of focal plane array 20 which is exemplified by substrate 10 of FIG. 1. If the IR energy were directly incident upon substrate 10, the energy incident upon the surface area located between the IR sensors 12 would not be sensed by the elements 12 and would represent lost data. This is because the space between elements 12 is greater than the ten (10) micron wavelength of IR energy. To remedy this problem and still allow for the inclusion of antenna elements 14, the focused IR energy first passes through the microlens 24 which redirects substantially all of the energy to the individual sensing elements 12.

Figure 3:
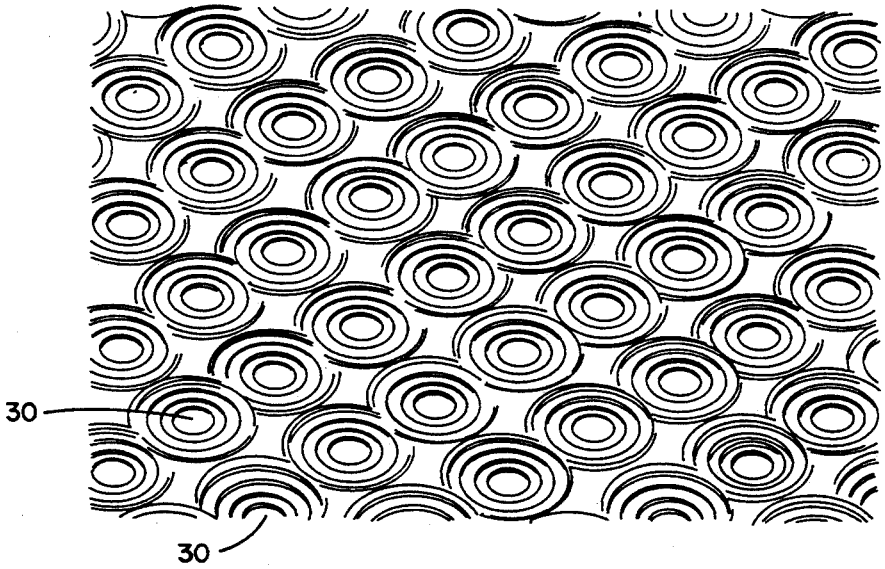
FIG. 3 is a plan view of an element of the embodiment of FIG. 2.

A magnified perspective view of such a microlens 24 is shown in FIG. 3 and includes a multiplicity of individual microlenses 30. Each microlens 30 corresponds to an individual sensing element 12 and collects the IR energy which would otherwise be incident upon the area surrounding the respective element 12, as well as the specific area covered by that element 12. The collected IR energy is generally all distributed to the nearest sensing element 12.

This technique of reducing the size of detector elements through the use of microlenses results in a reduction of the level of resolution available with the IR sensors. Pixel size is inversely proportional to resolution. The use of microlenses causes the effective pixel size of the elements 12 to be the actual size of the microlenses 31. This increase in pixel size is a reduction in resolution. The tradeoff in resolution, though not optimum for IR resolution, can still represent a significant resolution improvement over the alternative millimeter waves. By way of example, the wavelength and therefore best resolution of millimeter waves at 94 GHz is three (3) millimeters or (3000) microns. Increasing the effective pixel size of the IR elements 12 to (100) microns is still a (30) times improvement over the millimeter wave resolution.

The microlens 24 is further constructed to have a thickness which is smaller than the wavelength of the MMW energy, thus causing microlens 24 to be transparent to the MMW energy. Depending upon the application of the sensor array and the material used for microlens 24, its thickness may range from a few microns up to one hundred microns, which is still insignificant and, therefore, transparent to millimeter wavelengths.

There are many possible ways to design microlenses. One simple design example is presented using a Fresnel zone plate arrangement. For a zone plate with a half-wave correction, the successive radii of the zones are chosen so that the path length from a chosen focal point on the plate axis to each zone increases by one-half wavelength for successive zones. The radius of the nth zone, $R_n$, are defined by, $$R_n=\{nf\lambda+(n\lambda/2)^2\}^{\frac{1}{2}},$$

where n=1, 2, . . . , f is the focal length, and λ is the wavelength. The depth of each radius, d, is given by, $$d = \lambda/2(\sqrt{\epsilon} - 1),$$

where ε is the dielectric constant of the lens. If silicon is used as the lens material, ε=12. For infrared wavelength at 10 μm, a zone plate microlens with a focal length of 100 μm can be made with the following parameters for d=2.0 μm.

TABLE 1

| n | $R_n$ (μm) |
|---|---|
| 1 | 32.0 |
| 2 | 45.8 |
| 3 | 56.8 |
| 4 | 66.3 |
| 5 | 75.0 |
| 6 | 83.1 |
| 7 | 90.7 |
| 8 | 98.0 |
| 9 | 105.0 |
| 10 | 111.8 |

The width of each zone needs to be less than half the wavelength. It can be chosen to be 2.5 (μm) for all zones, or adjustable widths based on the tradeoff between transmission area and phase coherence required. These parameters are well within the capability of photolithography. Technologies for fabricating microlenses are well established as exemplified by the article, "High Speed Binary Optic Microlens Array in GaAs", SPIE Vol. 1544, Miniature and Micro-Optics: Fabrication and System Applications (1991).

Conclusion

The present invention provides a dual mode imaging array which enables advantageous use of more than one mode of image acquisition. It enables the economical combination of different energy modes for common imaging applications. The detector arrays of the present invention can be constructed using a lithographic process without hybridization. The cost advantage over hybridization is even greater in the production of large scale arrays. The MMW and IR sensors are produced as different pixels on the same array resulting in a direct correspondence between the two. This correspondence allows data fusion to be accomplished in hardware without the need for complex software processing.

Other examples of imaging applications where both IR and MMW are potentially useful are medical thermal imaging, the detection of ice on aircraft wings, all-weather aircraft landing systems and multicolor detectors. Thus, dual mode image acquisition can be useful in overcoming the inherent limitations of single mode image acquisition.

The embodiments described above are intended to be taken in an illustrative and not a limiting sense. Various modifications and changes may be made to the above embodiments by persons skilled in the art without departing from the scope of the present invention as defined in the appended claims.

What is claimed is:

1. A monolithic integrated detector array for detecting both infrared, IR, and millimeter wave, MMW, energy, comprising:

an integrated circuit substrate having both IR sensing elements and MMW antenna elements formed within a predetermined area thereon;

said IR sensing elements including a first multiplicity of IR sensing elements substantially evenly distributed across the predetermined area of the substrate;

said MMW antenna elements including a second multiplicity of antenna elements distributed over the predetermined area with individual antenna elements being located between individual IR sensing elements; and lens means substantially covering the predetermined area for collecting substantially all of the IR energy incident thereon and for distributing collected IR energy to the multiplicity of IR sensing elements, said lens means being adapted to be substantially transparent to MMW energy incident upon the predetermined area.

2. The detector of claim 1, wherein the lens means has a thickness which is less than one-half of the wavelength of the incident MMW energy.

3. The detector of claim 2, wherein the lens means includes a multiplicity of microlenses with each microlens corresponding to a separate IR sensing element.

4. The detector of claim 1 wherein the distribution of the first multiplicity of IR sensing elements is orthogonal.

5. The detector of claim 1, wherein the integrated circuit substrate forms a focal plane.

6. The detector of claim 1, wherein each of the antenna elements is a dipole.

7. A monolithic integrated circuit detector array having elements for detecting incident energy having both respectively longer electromagnetic wavelengths and shorter optical wavelengths, comprising:

an integrated circuit substrate having different sensing elements for detecting energy having longer and shorter wavelengths, said sensing elements being distributed over a predetermined area of the substrate;

said sensing elements including a first multiplicity of sensing elements substantially evenly distributed across the predetermined area for detecting energy having the shorter optical wavelengths and a second multiplicity of sensing elements distributed over the predetermined area for detecting energy having the longer electromagnetic wavelengths, with individual elements of the second multiplicity of elements being located between individual elements of the first multiplicity of sensing elements; and lens means substantially covering the predetermined area for collecting substantially all of the shorter wavelength energy incident thereon and for distributing collected energy to the first multiplicity of sensing elements, said lens means being adapted to be substantially transparent to longer wavelength energy incident upon the predetermined area.

8. The detector array of claim 7, wherein said lens means has a thickness which is less than the longer wavelengths and thereby transparent to the longer wavelength energy.

* * * * *